US005983977A

United States Patent [19]

Nishimura et al.

[11] Patent Number: 5,983,977

[45] Date of Patent: Nov. 16, 1999

[54] SLEEVE FOR DIE CASTING MACHINES AND DIE CASTING MACHINE USING THE SAME

[75] Inventors: Takanobu Nishimura, Chigasaki; Masato Yada, Mie-ken, both of Japan

[73] Assignee: Kabushiki Kaisha Toshiba, Japan

[21] Appl. No.: 08/750,529

[22] PCT Filed: Jun. 13, 1995

[86] PCT No.: PCT/JP95/01177

§ 371 Date: Dec. 13, 1996

§ 102(e) Date: Dec. 13, 1996

[87] PCT Pub. No.: WO95/34394

PCT Pub. Date: Dec. 24, 1995

[30] Foreign Application Priority Data

Jun. 14, 1994 [JP] Japan ..... P6-132103

[51] Int. Cl.[6] ..... B22D 17/08; B22D 17/20

[52] U.S. Cl. ..... 164/312

[58] Field of Search ..... 164/312, 314

[56] References Cited

U.S. PATENT DOCUMENTS 5,223,214 6/1993 Culling ..... 420/41

FOREIGN PATENT DOCUMENTS 49-34422 3/1974 Japan .
56-30068 3/1981 Japan .
59-48946 11/1984 Japan .
61-177758 11/1986 Japan .
62-50062 3/1987 Japan .
63-72464 4/1988 Japan .
1-95860 4/1989 Japan .
2-39645 10/1990 Japan .
4-224066 8/1992 Japan ..... 164/312
4-224068 8/1992 Japan ..... 164/312
4-251650 9/1992 Japan ..... 164/312
5-302141 11/1993 Japan .
6-91358 4/1994 Japan ..... 164/312

OTHER PUBLICATIONS

Abstract of Japanese Patent Publication 1–180942 Published Jul. 18, 1989.

*Primary Examiner*—J. Reed Batten, Jr.
*Attorney, Agent, or Firm*—Finnegan, Henderson, Farabow, Garrett & Dunner, L.L.P.

[57] ABSTRACT

A sleeve (6) serving as both a molten metal receiver and a pressure cylinder for a die casting machine is formed out of a metal material having a thermal conductivity of not more than 20 W/mK. Concretely speaking, the sleeve (6) is formed out of an iron-based alloy containing at least 7–19 wt. % of Ni and having metallographic/structure comprising mainly a martensite phase or a mixed phase of a martensite phase and an austenite phase. The iron-based alloy contains at least one kind of metal selected from the group consisting of 3–8 wt. % of Si, 0.3–2 wt. % of C, and 0.03–0.1 wt. % of Mg and Ca, and not more than 1.0 wt. % of Mn, and this alloy is, for example, spherical graphite cast iron. Since the sleeve (6) is formed out of a metal material of such a low thermal conductivity, the mixing in of a solidification phase is minimized, and high reliability and durability can be obtained.

16 Claims, 6 Drawing Sheets

SLEEVE FOR DIE CASTING MACHINES AND DIE CASTING MACHINE USING THE SAME

TECHNICAL FIELD

This invention relates to a sleeve for a die casting machine used for die casting various light alloys represented by aluminum alloy and a die casting machine using the sleeve.

BACKGROUND ART

The die-cast product of a light alloy is manufactured by forcing the melt of the light alloy into a cavity in a pair of dies consisting of a die segment and a stationary die. A sleeve is connected through the medium of a bush to the cavity and an injection mouth formed in the sleeve is used for admitting the molten alloy. The incoming molten alloy is forced into the cavity with a plunger. In the die casting machine to be used for manufacturing die-cast products as described above, generally tool steel, SKD61, is used as the material for forming the sleeve.

In the die casting of such light alloys as mentioned above, it has been recently brought to light that particularly when the die casting machine adopted happens to be of the cold chamber type, the fall of the temperature of the molten alloy introduced into the cavity greatly affects the quality of the die-cast product. Specifically, it has been heretofore customary to cool the periphery of the sleeve for the purpose of protecting the sleeve against the heat of the molten alloy. The temperature of the molten alloy, therefore, is lowered and part of the molten alloy forms a solidification phase and the solidification phase directly leaks into the die-cast product, degrades the mechanical property and the air-tightness of the machine, or induces the occurrence of furrows on the product surface. It has been also found that when the sleeve is not subjected to forced cooling, insufficiency of the amount of the molten alloy to be injected into the sleeve enlarges the fall of the temperature and impairs the quality of the die-cast product.

For the solution of the problems mentioned above, the wisdom of heating the periphery of the sleeve to preclude the advance of solidification within the sleeve is being studied. By heating the periphery of the sleeve, the solidification phase can be prevented from entering the die-cast product. Since the heating tends to induce deformation of the sleeve, it ultimately degrades the durability of the die casting machine. The measure resorting to the heating still has the problem of impracticability because the material for the sleeve which is capable of overcoming such drawbacks as mentioned above has not yet been found.

The feasibility of using a ceramic material of excellent insulation and low thermal expansivity in part of the sleeve is also being studied. The ceramic material, however, has poor reliability of performance because it is deficient in shock resistance and rigidity. This measure has such problems as inflicting a crack on the interface because of a large difference in thermal expansion coefficient between the ceramic material and the material of the peripheral part. It further has a serious practical problem that the ceramic material is not easily molded in a complicated shape.

It has now become necessary that the material for the sleeve to be used in the die casting machine should acquire further improved thermal insulation and exhibit a small difference in thermal expansion coefficient from the plunger and the peripheral retaining parts thereof. The methods and the materials which have been heretofore used for the sleeve, therefore, are no longer capable of fulfilling the necessity mentioned above.

An object of this invention is to provide a sleeve for a die casting machine which offers high thermal insulation, possesses the ability to preclude entry of a solidification phase, and excels in reliability of performance, namely a sleeve for a die-casting machine which acquires enhanced durability. Another object of this invention is to provide a sleeve for a die casting machine which allays the difference in thermal expansivity from the peripheral parts and exalts the reliability and durability besides fulfilling the aforementioned conditions, namely a sleeve for a die casting machine which enjoys perfect castability and machinability. Still another object of this invention is to provide a die casting machine which, owing to the use of the sleeve of the quality mentioned above, enjoys improved yield and, at the same time, excels in durability and reliability.

DISCLOSURE OF THE INVENTION

The sleeve for a die casting machine of this invention is a sleeve concurrently serving as a molten metal receiver and a pressure cylinder in a die casting machine and characterized by being formed of a metal material metallographically comprising a martensite phase or a mixed phase of a martensite phase with an austenite phase as a main component and having thermal conductivity of not more than 20 W/mK. By forming the sleeve for a die casting machine with the metal material metallographically comprising a martensite phase or a mixed phase of a martensite phase with an austenite phase as a main component and having thermal conductivity of not more than 20 W/mK as described above, the solidification of the molten metal in the sleeve can be curbed and the reliability of the sleeve itself can be exalted. If the thermal conductivity of the metal material for forming the sleeve exceeds 20 W/mK, the sleeve will neither acquire ample insulation nor permit ample repression of solidification of the molten metal within the sleeve. If the texture of the metal material for the formation of the sleeve does not comprise a mixed phase of a martensite phase with an austenite phase as a main component, the sleeve will not acquire fully satisfactory durability and reliability because the metal material fails to offer ample resistance to abrasion and to galling and preclude deformation by heat fully satisfactorily. In order for the metal material to offer notably improved resistance to abrasion and galling and preclude deformation by heat sufficiently, the mixed phase of a martensite phase with an austenite phase appropriately contains the martensite phase at a proportion of not less than 10% of surface area ratio.

When the sleeve is formed of other material than the metal material such as, for example, a ceramic material, it does not easily acquire perfect reliability.

The sleeve for a die casting machine according to this invention described above is characterized particularly in that the metal material comprises an iron-based alloy containing at least Ni. The Ni-containing iron-based alloy metallographically comprising a martensite phase or a mixed phase of a martensite phase with an austenite phase manifests such hardness as exceeds Hv 300 on the Vickers hardness scale and such low thermal expansivity as is evinced by a thermal expansion coefficient falling in the range of $11\times10^{-6}$ to $16\times10^{-6}$/K besides enjoying low thermal conductivity. Since the resistance to abrasion or to galling can be improved and the decline of clearance due to deformation by heat can be prevented as a result, the sleeve for a die casting machine is enabled to acquire further improvement in durability and reliability.

The die casting machine of this invention is characterized by comprising a pair of dies consisting of a stationary die and a movable die, a bush disposed in the stationary die, a sleeve connected to the bush, adapted to serve concurrently as a molten metal receiver and a pressure cylinder, and formed of a metal material metallographically comprising a martensite phase or a mixed phase of a martensite phase with an austenite phase as a main component and having thermal conductivity of not more than 20 W/mK, a plunger for causing the molten metal introduced into the sleeve to be forced into the pair of dies, and a drive mechanism for the plunger.

BEST MODE FOR CARRYING OUT THE INVENTION

Now, this invention will be described below with reference to working examples.

Figure 1:
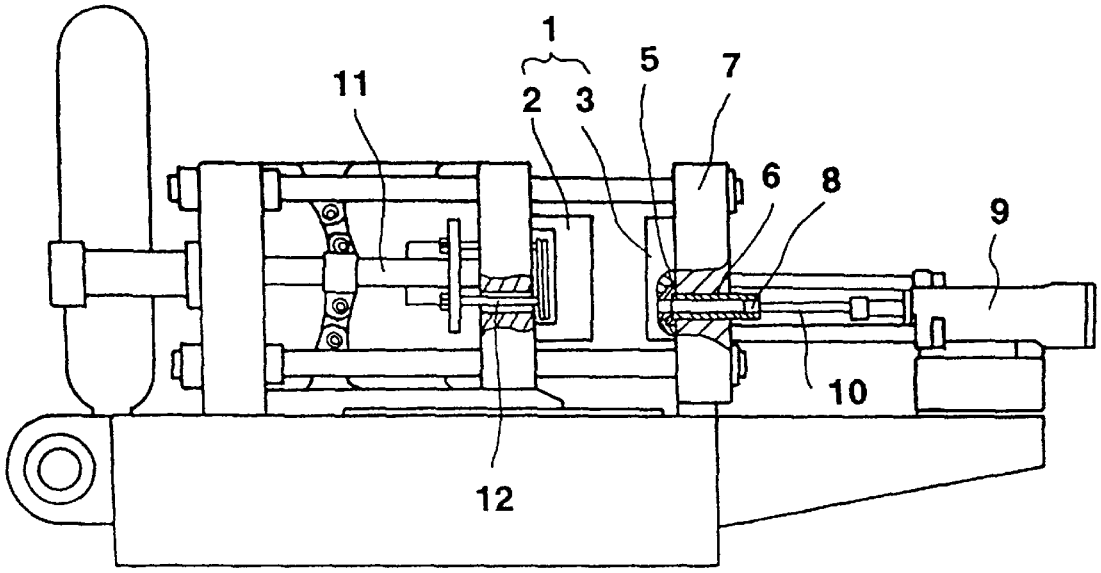
FIG. 1 is a partially sectioned diagram illustrating the construction of a die casting machine according one embodiment of this invention.
Figure 2:
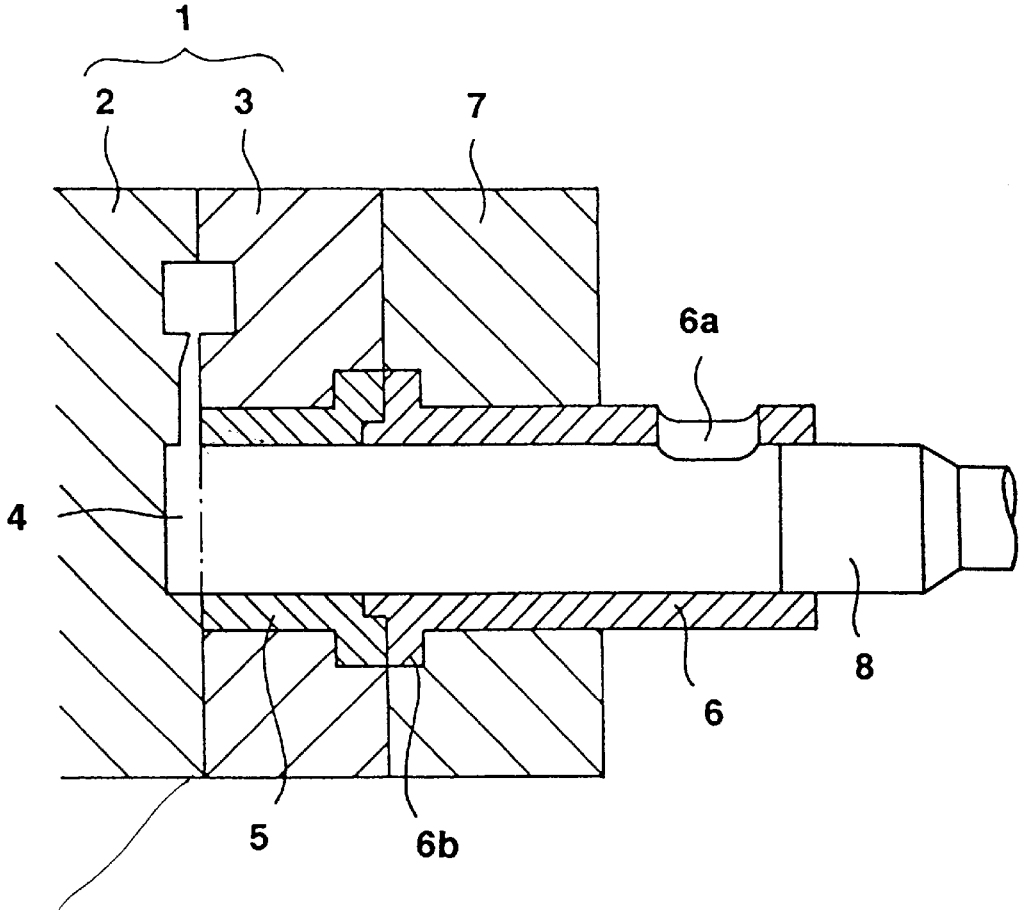
FIG. 2 is a cross section illustrating on a magnified scale the essential part of the die casting machine shown in FIG. 1.

FIG. 1 is a diagram illustrating the construction of a die-casting machine according to one embodiment of this invention. FIG. 2 is a diagram illustrating as magnified the essential part thereof. In these diagrams, 1 represents a pair of dies consisting of a movable die 2 and a stationary die 3. The pair of dies 1 defines a cavity 4. Inside the stationary die 3, a bush 5 is so disposed as to be connected to the cavity 4. To the bush 5 is also connected a sleeve 6. The sleeve 6 is supported by a platen 7.

Figure 3:
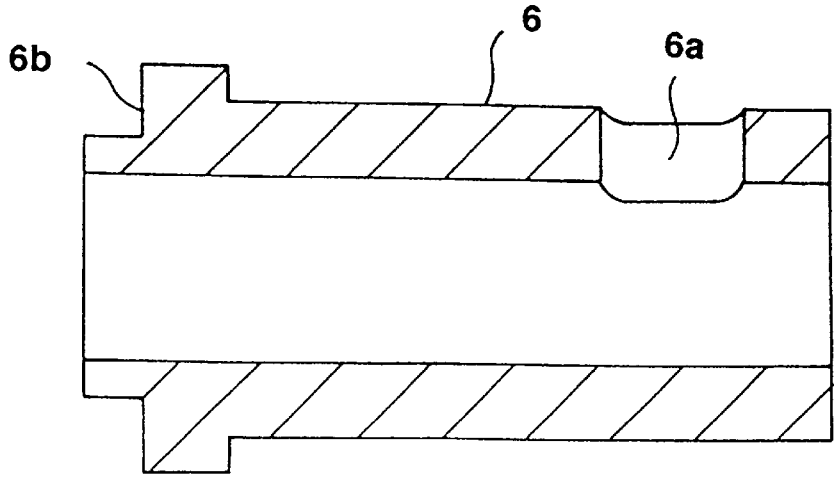
FIG. 3 is a cross section illustrating the construction of a sleeve for a die casting machine according to one embodiment of this invention.

The sleeve 6 assumes a cylindrical shape as illustrated in FIG. 3. The sleeve 6 is provided one terminal side thereof with a molten metal inlet 6*a* and on the other terminal side thereof with a flange 6*b*. The molten metal is poured in through the molten metal inlet 6*a* provided in the sleeve 6. Inside the sleeve 6, a plunger tip 8 is movably disposed. To the plunger tip 8 is connected a plunger rod 10 which is driven by a drive mechanism such as, for example, a hydraulic cylinder 9. The molten metal poured in through the molten metal inlet 6*a* is forced into the cavity 4 by the plunger tip 8 when the hydraulic cylinder 9 is actuated.

The movable die 2 is adapted to be moved by a die moving mechanism such as, for example, a hydraulic cylinder 11. When this movable die 2 is moved in a prescribed direction, a die-cast product manufactured inside the cavity 4 is discharged from the dies by an extruding rod 12 which is fixed in position. The extruding rod 12 serves to exhaust the die-cast product manufactured inside the cavity 4 from the cavity 4.

In the die casting machine described above, the sleeve 6 is formed of a metal material which metallographically comprises a martensite phase or a mixed phase of a martensite phase with an austenite phase as a main component and has thermal conductivity of not more than 20 W/mK. By forming the sleeve 6 of such a metal material as possesses the metallographic texture and thermal conductivity mentioned above, the solidification of the molten metal within the sleeve 6 can be repressed and, at the same time, the reliability of the sleeve 6 itself can be exalted. If the thermal conductivity of the metal material of which the sleeve 6 is formed exceeds 20 W/mK, the metal material will not acquire ample insulation and will not amply prevent the molten metal in the sleeve 6 from being solidified. Appropriately, the thermal conductivity of the metal material is not more than 18 W/mK, preferably not more than 16 W/mK. If the metal material of which the sleeve 6 is formed does not metallographically comprise a martensite phase or a mixed phase of a martensite phase with an austenite phase as a main component, it will be unable to impart ample durability and reliability to the sleeve because it will not offer ample resistance to abrasion or galling or allow ample preclusion of deformation of the sleeve by heat. Generally in the die casting of an aluminum-based alloy, since the working temperature of the sleeve 6 is in the approximate range of 373 to 673 K, the metal material appropriately satisfies the thermal conductivity mentioned above in this temperature range. It is, however, when the temperature of the sleeve 6 or that of the molten metal is low that the partial solidification of the molten metal mentioned above poses a problem. The thermal conductivity mentioned above, therefore, is appropriately satisfied particularly in the temperature range of 373 to 423 K.

As a concrete example of the metal material having thermal conductivity of not more than 20 W/mK, an iron-based alloy having a high Ni content may be cited. Ni forms a solid solution with Fe in a wide range of ratio of combination up to about 76 wt % Ni—Fe. In the intermediate range (in the approximate range of 20 to 40 wt % Ni) of this solid solution range, the area of low thermal conductivity exists. It is an austenite phase that forms the main phase of the iron-based alloy having a Ni content in the approximate range of 20 to 40 wt % mentioned above. The low thermal conductivity can be obtained because the regularity of crystal is lowered and the motion of electrons and phonons which govern the conduction of heat in metal is decelerated in accordance as the composition deviates from the pure Fe having high regularity of crystal structure or from the 76 wt % Ni—Fe forming an intermetallic compound $FeNi_3$. The Ni-containing iron-based alloy which is formed solely of an austenite phase has low rigidity and imparts no sufficient durability to the sleeve 6. The thermal conductivity of this alloy begins to rise when the Ni content thereof is in the neighborhood of below 20% by weight.

When the Ni-containing iron-based alloy is caused to form in the metallographic texture thereof not less than 10% by surface area ratio of a martensite phase, it acquires an increase in rigidity and represses a rise of thermal conduction even when the Ni content is below 19% by weight and consequently fulfills thermal conductivity of not more than 20 W/mK. Further, the Ni-containing iron-based alloy which has formed a martensite phase therein can fulfill the requirement for low thermal expansivity. The hardness of the Ni-containing iron-based alloy having not less than 10% by surface area ratio of a martensite phase is not less than Hv 300 on the Vickers hardness scale, for example. By using the Ni-containing iron-based alloy of such high hardness as mentioned above as the material for the formation of the sleeve 6, the produced sleeve 6 can be improved in resistance to abrasion or to galling.

As regards the low thermal expansivity of the Ni-containing iron-based alloy which has produced a martensite phase therein, the thermal expansion coefficient of this alloy is specifically in the approximate range of 11 to $16\times10^{-6}$/K in the temperature range of from room temperature to 573 K in which the sleeve 6 is heated. Since the peripheral parts of the sleeve such as, for example, the bush 5, platen 7, and plunger tip 8 are generally made of ductile cast iron, for example, the peripheral parts of the sleeve and the sleeve 6 are allowed to have substantially equal thermal expansion coefficients. As a result, the thermal deformation of the sleeve 6 and the peripheral parts thereof is repressed. The decline of the clearance attendant on the thermal deformation and the galling consequently induced, therefore, can be prevented.

The resistance of the sleeve 6 to abrasion and galling can be improved and, at the same time, the decline of the clearance attendant on thermal deformation can be prevented by using the Ni-containing iron-based alloy which has a metallographic texture producing a martensite phase therein as described above. The sleeve 6 which is formed of the Ni-containing iron-based alloy which has a metallographic texture producing a martensite phase therein, therefore, amply represses solidification of the molten metal and, at the same time, acquires outstanding durability and reliability.

As concrete examples of the metallographic texture of the Ni-containing iron-based alloy as the material for the formation of the sleeve 6, a texture formed mainly of a mixed phase of a martensite phase with an austenite phase and a texture formed mainly of a martensite phase may be cited. The mixed phase of a martensite phase with an austenite phase may have a texture such that the martensite phase may be dispersed in the austenite phase as the main phase. The surface area ratio of the martensite phase nevertheless is appropriately equal to or greater than that of the austenite phase. Preferably, the mixed phase has a martensite phase as a main phase thereof (not less than 60% by surface area ratio, for example). Though the Ni-containing iron-based alloy is allowed to have a metallographic texture which is formed substantially solely of a martensite phase, the metallographic texture appropriately has a residual austenite phase for the sake of improving toughness and service life before fatigue and, at the same time, acquiring perfect workability.

The metallographic texture of the Ni-containing iron-based alloy is varied by the Ni content, the Si content which will be specifically described herein below, the cooling speed after the casting or heat treatment, etc. Appropriately, the Ni content in the Ni-containing iron-based alloy is set in the range of 7 to 19% by weight for the purpose of ensuring the production of the martensite phase as described above and consequently fulfilling the requirements for low thermal conductivity and low thermal expansivity. If the Ni content in the iron-based alloy mentioned above is less than 7% by weight, the amount of Ni in the solid solution thereof with iron will decrease, the thermal conductivity will increase, the texture will give rise to a soft ferrite phase or perlite phase, and the durability will decline. Conversely, if the Ni content exceeds 19% by weight, the amount of the martensite phase to be produced will decrease and the thermal conductivity and the thermal expansion coefficient will both increase. Preferably the Ni content is set in the range of 10 to 15% by weight because the alloy having this Ni content acquires low thermal conductivity.

The Ni-containing iron-based alloy described above is enabled to have the thermal conductivity thereof further lowered by incorporating therein a solid solution alloy element having a large difference in atomic radius from iron. As concrete examples of the element, Si, Al, Ti, etc. may be cited. Since Al forms an intermetallic compound with Ni ($Ni_3Al$) and Ti forms a carbide, these elements have the possibility of rather increasing the thermal conductivity. Since these elements are allowed to be incorporated in extremely small amounts, their effects are meager. Al, in an approximate amount of not more than 0.5% by weight, manifests an effect in lowering the thermal conductivity. In contrast, Si avoids forming an intermetallic compound and can be incorporated in an approximate amount of up to 8% by weight in the Ni—Fe alloy and consequently serves as an effective element for lowering the thermal conductivity. When a 7 to 19 wt % Ni—Fe alloy is caused to add 7% by weight of Si, the addition results in forming an intermetallic compound $Ni_3Si$. When the amount of Si so incorporated is up to about 8% by weight, the thermal conductivity can be lowered owing to the contribution of a solid solution to be formed consequently. The effect of the addition of Si in lowering the thermal conductivity becomes conspicuous when the amount of Si increases to the proximity of 3% by weight. By increasing the Si content to a relatively high level, the production of the martensite phase can be easily attained. Appropriately, therefore, the Si content in the Ni-containing iron-based alloy is in the range of 3 to 8% by weight.

For the sake of obtaining a metallographic texture having produced therein the martensite phase as described above, the rate at which the sleeve 6 formed of the Ni-containing iron-based alloy is to be cooled after the casting or the heat treatment is properly not more than 10 K/min. Though the Ni content and the Si content conform with the standards specified above, an excess of the cooling speed after the casting or the heat treatment over 10 K/min is liable to increase the amount of the austenite phase, lower the hardness, and raise the thermal expansion coefficient. For the sake of attaining a cooling speed of not more than 10 K/min after the casting, the sleeve properly has a wall thickness of not less than 10 mm.

Appropriately, the Ni-containing iron-based alloy destined to serve as the material for forming the sleeve 6 is used as cast iron by further incorporating therein 0.6 to 2.0% by weight of C, 0.03 to 0.1% by weight of at least one element selected from between Mg and Ca, and not more than 1.0% by weight of Mn. The alloy, by adding C and inducing precipitation of graphite crystals in the metallographic texture thereof, is enabled to acquire the same castability and machinability as are common to ordinary cast iron. If the C content is less than 0.6% by weight, the crystallization of graphite will not occur. If it exceeds 2.0% by weight, coarse graphite will arise and the strength will decline. As concerns the thermal conductivity, the effectiveness of carbon in a solid solution in lowering the thermal conductivity grows in accordance as the amount of carbon increases. It is further appropriate to set the total carbon content in a low range of from 0.6 to 1.0% by weight. When the machinability constitutes an important consideration, it is proper to set the C content in the range of from 1.5 to 2.0% by weight. By using a cast iron material excelling in castability and machinability as described above, the sleeve 6 which is capable of producing the effect mentioned above can be provided at a low cost.

Graphite itself is a good conductor of heat. The graphite flakes continue into one another and, therefore, have good possibility of impairing low thermal conductivity. The graphite is appropriately spheroidized by addition to the alloy of at least one element selected from between Mg and Ca in an amount in the range of 0.03 to 0.1% by weight. The graphite in the graphitized texture has only a sparing effect on thermal conductivity because the graphite spheres independently exist in the matrix of iron. If the content of Mg or Ca is less than 0.03% by weight, the carbon will not be amply spheroidized. Conversely, if the content of Mg or Ca exceeds 1.0% by weight, the excess will go to form a carbide (such as, for example, $MgC_2$ or $CaC_2$) and entrain an increase in thermal conductivity.

Mn is a basic component of cast iron and functions as a deoxidizer and a component for enhancing corrosion resistance. If the content of Mn exceeds 1.0% by weight, the excess gives rise to a carbide {$(Fe, Mn)_3C$, for example} and raises thermal conductivity. It is, therefore, proper to set the upper limit of the Mn content at 1.0% by weight.

Figure 4:
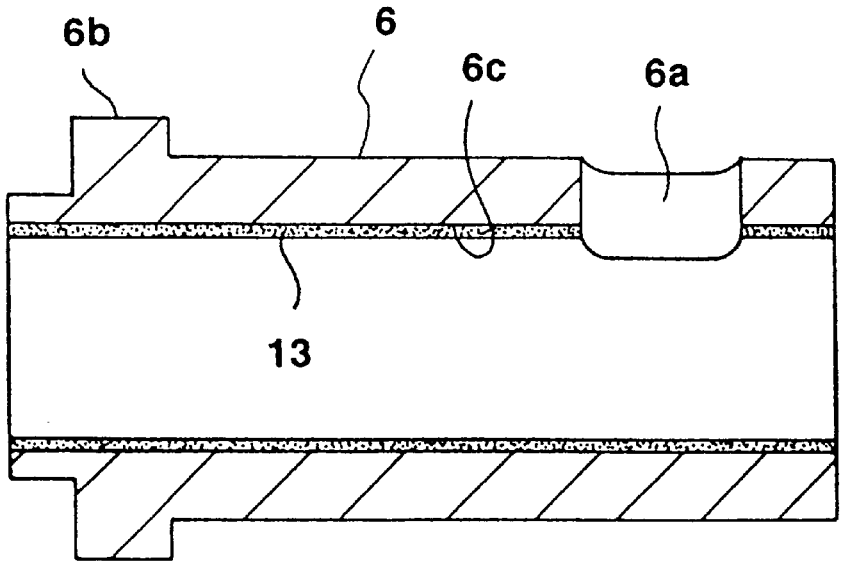
FIG. 4 is a cross section illustrating a typical modification of the sleeve for a die casting machine shown in FIG. 3.

When the Ni-containing iron-based alloy mentioned above, specifically the Ni-containing spheroidal graphite cast iron, is used as the material for the formation of the sleeve 6, it is appropriate to form a surface-treated layer of high hardness such as, for example, a ceramic layer 13 on the inner wall surface 6*c* of the sleeve 6 as illustrated in FIG. 4. As concrete examples of the surface-treating method for the formation of the ceramic layer 13, the treatment of nitriding, treatment of boriding, treatment of carburizing, etc. may be cited. The use of the surface-treating method permits production of a ceramic layer 13 of high hardness having a nitride, a boride, or carbide as a main component. The ceramic layer 13 of high hardness imparts improved abrasion resistance to the sleeve 6. As a result, the galling and the abrasion between the inner wall surface 6*c* of the sleeve 6 and the plunger tip 8 is prevented more effectively. Further, the nitride, boride, or carbide which exists as the ceramic layer 13 can bring about an effect of enhancing the resistance to corrosion caused as by the molten aluminum.

Preparatorily to the formation of the ceramic layer 13 as described above; it is appropriate for the Ni-containing iron-based alloy to have incorporated therein such elements as Cr, W, and Mo which readily form a nitride, a boride, or a carbide. The preparatory incorporation of these elements enables the ceramic layer 13 to be formed in a large thickness. Specifically, the surface treatment such as the treatment of nitriding, treatment of boriding, treatment of carburizing, etc. enables the nitride, boride, carbide, etc. to be formed to a greater depth. If the carbide is formed in other part than the surface part, it will raise the thermal conductivity. It is proper, therefore, to minimize the amounts of such element as Cr, W, Mo, etc. to be added, specifically to amounts of not more than 2% by weight, for example.

Figure 5:
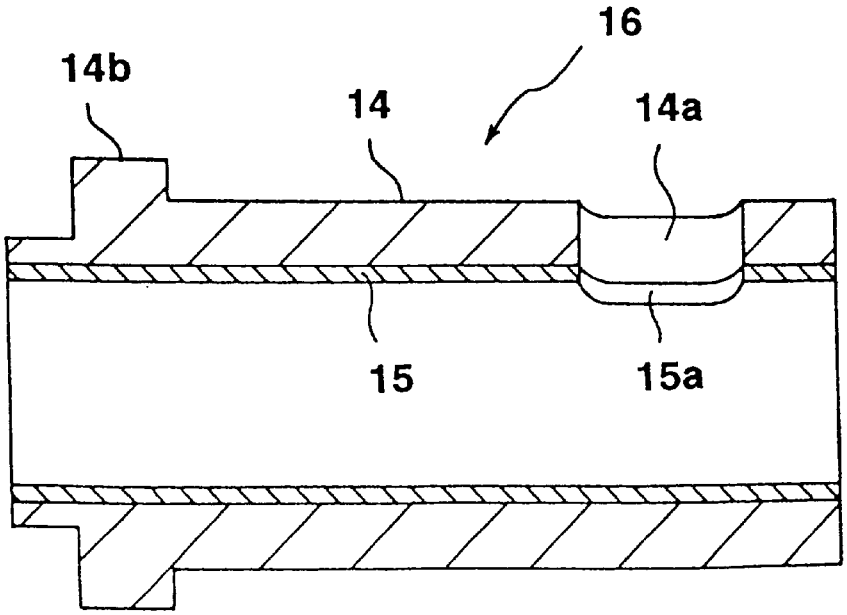
FIG. 5 is a cross section illustrating the construction of a sleeve for a die casting machine according to another embodiment of this invention.

FIG. 5 is cross section illustrating the construction of a sleeve for a die casting machine according to another embodiment of this invention. In FIG. 5, 14 represents a sleeve of low thermal conductivity which is formed of the same metal material of low thermal conductivity as is described in the preceding embodiment, i.e. an Ni-containing iron-based alloy possessing a metallographic texture which has produced a martensite phase, for example. The sleeve 14 of low thermal conductivity is provided with a molten metal inlet 14*a*. Inside this sleeve 14 of low thermal conductivity, a cylinder 15 provided similarly with a molten metal inlet 15*a* is inserted. The cylinder 15 is formed of an abrasion-resistant alloy or a corrosion-resistant alloy different in species from the metal material of which the sleeve 14 of low thermal conductivity. The sleeve 14 of low thermal conductivity and the cylinder 15 jointly form a double-wall sleeve 16.

The Ni-containing iron-based alloy mentioned above (and the Ni-containing spheroidal graphite cast iron as well) has a thermal expansion coefficient closely approximating to that of tool steel. When the cylinder 15 formed of an abrasion-resistant alloy or a corrosion-resistant alloy, specifically tool steel, is used as inserted in the sleeve 14 of low thermal conductivity, therefore, it cannot induce thermal deformation while in service. The double-wall sleeve 16 relies on the sleeve 14 of low thermal conductivity on the periphery to fulfill the role of insulation and the cylinder 15 inserted therein to discharge the role of abrasion with the plunger tip 8. It is, therefore, permits further enhancement of durability.

Now, concrete examples of the sleeve and the die casting machine of the embodiment cited above and the results of the rating thereof will be described below.

EXAMPLES 1 AND 2, COMPARATIVE EXAMPLES 1 AND 2, AND REFERENTIAL EXAMPLES 1 AND 2

Varying casting materials of compositions shown in Table 1 were each melted in a high-frequency induction electric oven of 100 kg and cast by the use of a FURAN sand casting die to produce a sleeve of a structure shown in FIG. 3. The sleeve of Example 1 had a cast wall thickness of 20 mm and the sleeve of Example 2 a cast wall thickness of 6 mm. The cooling speed (to 423 K) of the sleeve of Example 1 after the casting was 0.1 K/sec and the cooling speed (to 423 K) of the sleeve of Example 2 after the casting was 1.0 K/sec. Table 1 additionally show the properties of the casting materials mentioned above.

For comparison with the present invention, sleeves of the same shape as in the working examples mentioned above were manufactured by using tool steel, SKD61, as a conventional material (hardened material) (Comparative Example 1) and a casting material of a composition shown in Table 1 having a small Ni content (Comparative Example 2). The sleeves of Comparative Example 1 and Comparative Example 2 both had a wall thickness of 15 mm. The cooling speed (to 423 K) of these sleeves after the casting was 0.3 K/sec. For Referential Examples 1 and 2, sleeves of the same shape as in the working examples mentioned above were manufactured by using austenite grade casting material of the compositions shown in Table 1. The sleeves of Referential Examples 1 and 2 both had a wall thickness of 20 mm. The cooling speed (to 423 K) of the sleeves of Referential Examples 1 and 2 after the casting was 0.3 K/sec. Table 1 additionally shows the compositions and properties of Comparative Examples 1 and 2 and Referential Examples 1 and 2.

TABLE 1

| Example 1 | Example 2 | Comparative Example 1 (SKD61) | Comparative Example 2 | Referential Example 1 | Referential Example 2 |
|---|---|---|---|---|---|
| Composition of alloy (% by weight) | | | | | |
| C:1.5 Si:5.0 Mn:0.6 Ni:13.0 Mg: 0.04 P:0.02 S:0.01 Fe: balance | C:0.9 Si:4.5 Mn:0.5 Ni:15.0 Mg:0.04 P:0.03 S:0.01 Fe: balance | C:0.40 Si:1.0 Mn:0.2 Cr:5.0 Mg:1.2 V:0.9 P:0.01 S:0.01 Fe: balance | C:0.2 Si:2.5 Mn:0.7 Ni:5.0 Mg:0.05 P:0.03 S:0.01 Fe: balance | C:2.5 Si:3.5 Mn:0.6 Ni:25.0 Mg:0.05 P:0.02 S:0.01 Fe: balance | C:2.0 Si:5.0 Mn:0.5 Ni:20.0 Mg:0.04 P:0.01 S:0.01 Fe: balance |
| Properties | | | | | |
| Thermal conductivity (W/m K) *1 | 15 | 16 | 29 | 30 | 10 | 12 |
| Thermal expansion coefficients (×10-6/K) *2 | 15 | 14 | 12 | 13 | 21 | 19 |
| Hardness | Hv 550 | Hv 400 | Hv 500 | Hv 360 | Hv 148 | Hv 202 |

*1: 373K,
*2: RT-573K

Figure 7:
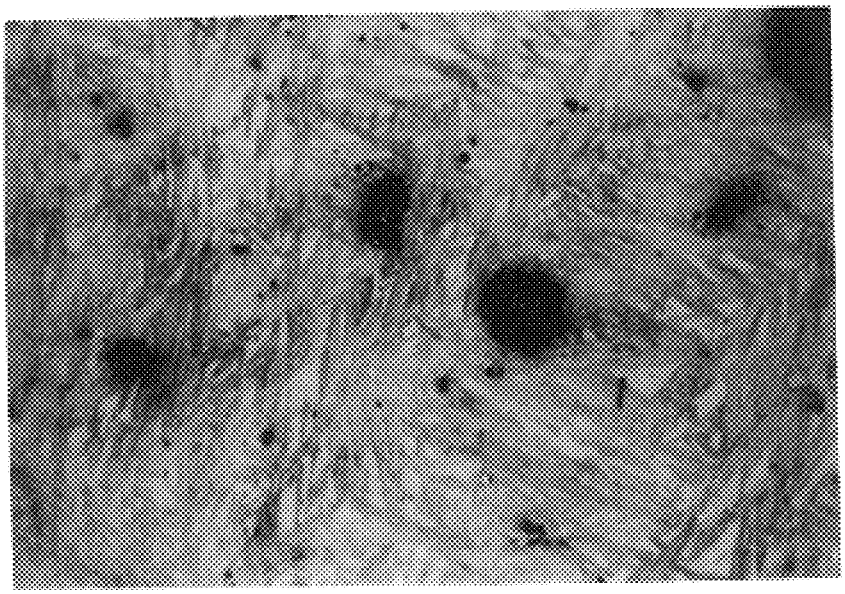
FIG. 7 is a photomicrograph illustrating on a magnified scale the metallographical texture of a sleeve for a die casting machine manufactured in Example 1 of this invention.

A test piece was cut from the sleeve (cast product) of Example 1 and this test piece was observed under a microscope (200 magnifications) to determine the metallographic texture thereof. A photomicrograph of the metallographic texture is shown in FIG. 7. It is clearly noted from FIG. 7 that the metallographic texture produced spheroidal graphite crystals therein and possessed about 90% by surface area ratio of a martensite phase. The sleeve (cast product) of Example 2 was similarly observed under a microscope (200 magnifications) to determine the metallographic texture. The metallographic texture was found to have produced spheroidal graphite crystals therein and formed about 20% by surface area ratio of a martensite phase.

Figure 8:
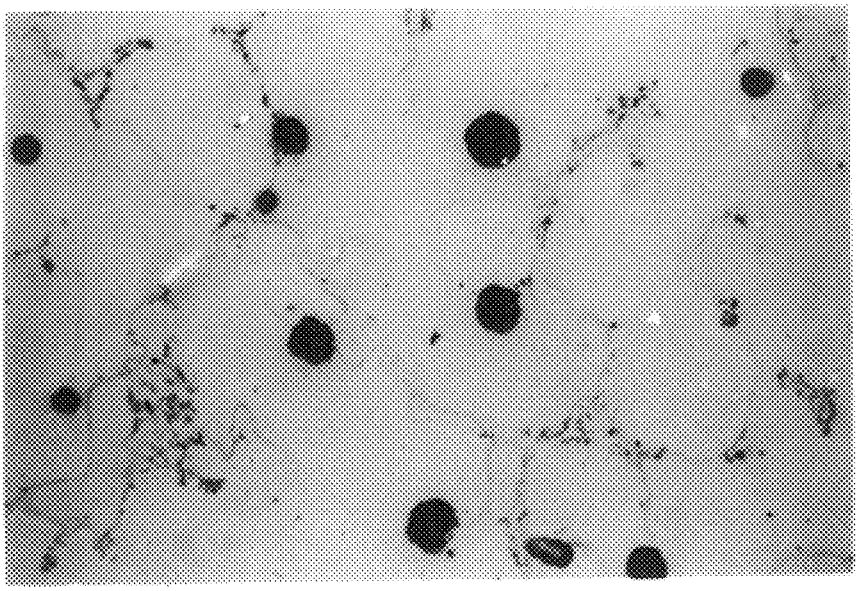
FIG. 8 is a photomicrograph illustrating on a magnified scale the metallographical texture of a sleeve for a die casting machine manufactured in referential example 1.

The sleeve (cast product) of Comparative Example 2 was similarly observed under a microscope (200 magnifications) to determine the metallographic texture. The metallographic texture is found to have formed about 30% by surface area ratio of a martensite phase and the balance of a perlite phase. The reason for this texture is that the Ni content of the sleeve had an unduly low Ni content. A photomicrograph (200 magnifications) of the metallographic texture of the sleeve (cast product) of Referential Example 1 is shown in FIG. 8. It is clearly noted from FIG. 8 that the sleeve of Referential Example 1 produced spheroidal graphite crystals and formed nearly 100% of an austenite phase, with no sign of production of a martensite phase. The surface area ratio of the martensite phase in the sleeve of Referential Example 2 was about 5%.

Figure 6:
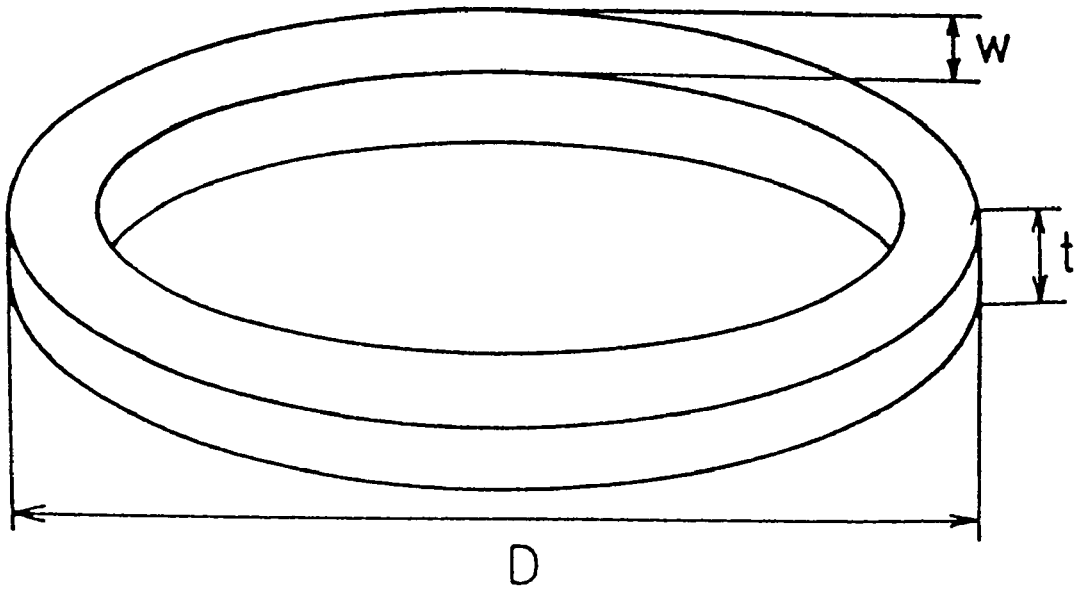
FIG. 6 is a perspective view illustrating the shape of a product subjected to a die casting test in one embodiment of this invention.

The sleeves of Examples 1 and 2, Comparative Examples 1 and 2, and Referential Examples 1 and 2 mentioned above were each set in place in a 250-ton die casting machine illustrated in FIG. 1 and die-cast experimentally under the conditions shown in Table 2. The die casting produces annular products, 150 mm in outside diameter D, 10 mm in cross-sectional size w, and 10 mm in thickness t, as shown in FIG. 6. The annular products of this construction, because of a large ratio of surface area to volume, incur a sharp decline of the temperature of molten metal and pose the occurrence of furrows on the product surface as a serious problem. The sleeves were rated for resistance to galling based on the degree of occurrence of streaks on the inner wall of sleeve. The ratings of the sleeves for resistance to galling were on a par with those of the conventional nitrided hardened material, SKD61.

The results of the experimental die casting of the sleeves (yields of products) and the results of the rating for resistance to galling are shown additionally in Table 3.

TABLE 2

| Die casting conditions | |
|---|---|
| Alloy material | Al alloy, ADC12 |
| Die casting machine | 250t |
| Weight of melt cast | 515g(products:190g, 2 pieces cast) |
| Sleeve filing ratio | 21% |
| Sleeve diameter | 60mm |
| Injection speed | 0.5–2.0m/s |
| Temperature of molten metal | 963K |
| Casting pressure | 590kgf/cm2 |
| Die temperature | 553K |

TABLE 3

| | Yield of product (%) | | | | | Resistance |
|---|---|---|---|---|---|---|
| Injection speed (m/s) | 0.5 | 0.8 | 1.2 | 1.7 | 2.0 | to galling |
| Example 1 | 100 | 100 | 90 | 80 | 50 | Very satisfactory |
| Example 2 | 100 | 100 | 82 | 55 | 30 | Satisfactory |
| Comparative Example 1 | 100 | 86 | 3 | 0 | 0 | Satisfactory |
| Comparative Example 2 | 100 | 70 | 2 | 0 | 0 | Rather satisfactory |
| Referential Example 1 | 100 | 100 | 95 | 87 | 62 | Bad |
| Referential Example 2 | 100 | 100 | 93 | 85 | 60 | Bad |

It is noted from Table 3 that the sleeves of Example 1 and Example 2 incurred the occurrence of furrows on the product surface to a lesser extent and afforded the products with a highly satisfactory yield even in the area of low injection speed at which the gas would be enfolded and the die corroded only sparingly. It is further noted that the sleeves had no problem of entailing deformation or decline of clearance due to thermal expansion and excelled in resistance to galling because the thermal expansion coefficients thereof were on a par with that of the material, SKD61, for the platen and the plunger and further because they had high degrees of hardness.

In contrast, when the sleeve of Comparative Example 1 was used, the products formed furrows on the surface thereof and suffered poor yield because of high thermal conductivity. When the sleeve of Comparative Example 2 was used, the products similarly suffered poor yield because the thermal conductivity was high. The sleeves of Referential Examples 1 and 2 at first afforded products with high yield because of low thermal conductivity. They, however, offered poor resistance to galling and revealed dubious practicability because they had low hardness and further because they showed widely different thermal expansion coefficients from the material for the platen or the plunger.

EXAMPLES 3 TO 7

Figure 9:
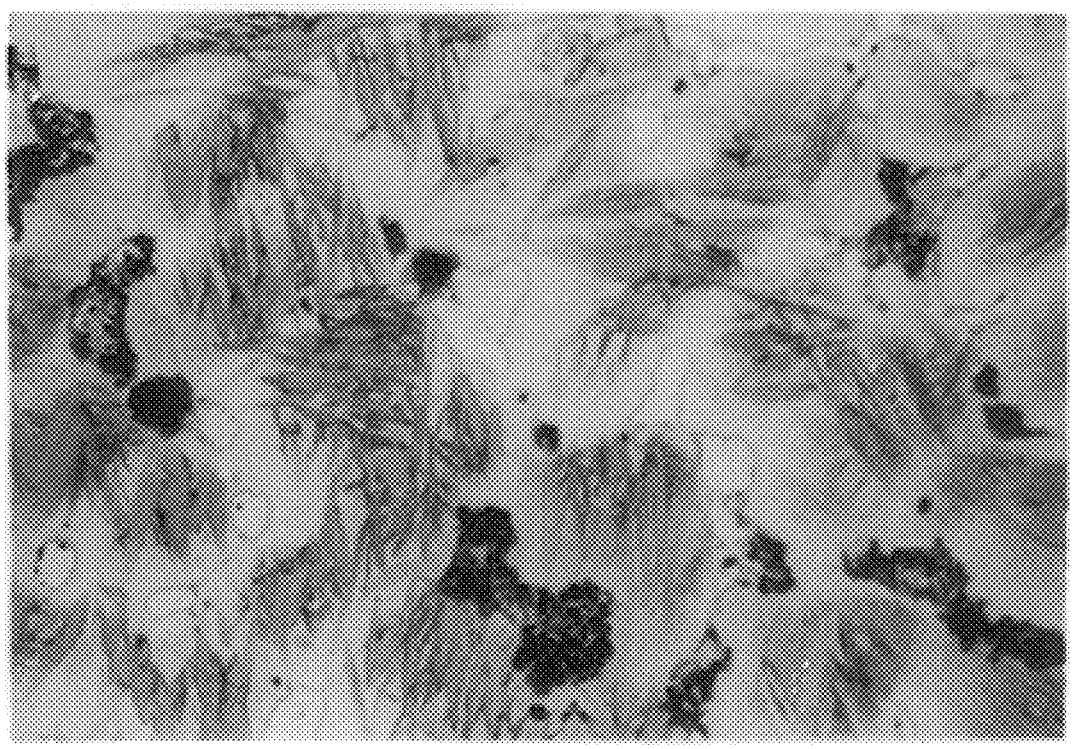
FIG. 9 is a photo-micrograph illustrating on a magnified scale the metallographical texture of a sleeve for a die casting machine manufactured in Example 4 of this invention.

Sleeves of the same shape as those of Example 1 (excepting a wall thickness of 15 mm) were manufactured by using cast iron materials whose compositions, cooling speeds, surface area ratios of martensite phase, and various properties were shown in Table 4. These sleeves were each tested for performance and durability with a die casting machine under the same conditions as those of Example 1. The yields of products and the degrees of resistance to galling obtained at an injection speed of 1.2 m/s are shown additionally in Table 4. FIG. 9 shows a photomicrograph (200 magnifications) of the metallographic texture of the sleeve of Example 4.

TABLE 4

| | | Example | | | | |
|---|---|---|---|---|---|---|
| | | 3 | 4 | 5 | 6 | 7 |
| Alloy Composition (% by weight) | C | 1.5 | 2.0 | 1.0 | 1.0 | 1.5 |
| | Si | 5.8 | 3.2 | 4.5 | 5.0 | 5.0 |
| | Mn | 0.8 | 0.9 | 0.4 | 0.5 | 0.7 |
| | Ni | 7.0 | 10.0 | 12.0 | 16.0 | 19.0 |
| | Mg | 0.04 | 0.05 | 0.03 | 0.07 | 0.05 |
| | P | 0.008 | 0.01 | 0.01 | 0.02 | 0.02 |
| | S | 0.004 | 0.005 | 0.003 | 0.002 | 0.005 |
| | Fe | balance | balance | balance | balance | balance |
| Wall thickness (mm) | | 15 | 15 | 15 | 15 | 15 |
| Cooling speed (K/sec) *3 | | 0.3 | 0.3 | 0.3 | 0.3 | 0.3 |
| Surface area ratio of martensite phase (%) | | 60 | 55 | 45 | 30 | 10 |
| | | Properties | | | | |
| Thermal conductivity (W/m K) *1 | | 15.8 | 15.0 | 14.8 | 15.6 | 14.0 |
| Thermal expansion coefficients (×10-6/K) *2 | | 13.2 | 13.8 | 14.0 | 14.2 | 16.0 |
| Hardness (Hv) | | 460 | 440 | 430 | 410 | 300 |
| Yield of product found by test under load (%) | | 76 | 90 | 92 | 80 | 93 |
| Resistance of galling | | Satisfactory | Satisfactory | Satisfactory | Satisfactory | Rather satisfactory |

*1: at 373K,
*2: RT-573K*1,
3: −423K

EXAMPLE 8

A sleeve was manufactured with cast iron of low thermal conductivity having the same composition as that of Example 1 and machined to prescribed dimensions. Then, a nitride layer was formed as the ceramic layer 13 by performing an ion nitriding treatment on the inner wall surface 6*a* of the sleeve 6 as shown in FIG. 4. This nitride layer served to improve the resistance to loss by fusion because it formed a nitride not easily wetted by molten Al. The nitride layer possessed hardness of Hv 1000 to 1200 and a depth of 5 to 10 $\mu$m.

The maximum number of shots obtained by the sleeve prior to the formation of the nitride layer without impairing the service life thereof was 5,000 to 10,000 on account of the loss by fusion into the molten aluminum and the wear by friction with the plunger. The formation of the nitride layer on the inner wall surface 6*a* of the sleeve 6 in the present example improved the maximum number of shots about three to four times to 20,000 to 40,000.

EXAMPLES 9 TO 14

Sleeves were manufactured with cast iron materials of low thermal conductivity having the same compositions as those of Examples 2 to 7 and machined to prescribed dimensions. Then, the inner wall surfaces of the sleeves manufactured with the same materials as those of Example 2 and Example 4 were subjected to a boriding treatment and the inner wall surfaces of the sleeves manufactured with the same materials as those of Example 2 and Example 4 were subjected to a nitriding treatment, severally to form a ceramic layer. In the sleeves of Examples 9 to 14, the formation of the ceramic layer improved the number of shots to about three to four times that prior to the formation of the ceramic layer.

EXAMPLE 15

A double-wall sleeve 16 was manufactured by inserting a cylinder 15 formed of SKD61 in a sleeve 14 of cast iron of low thermal conductivity having the same composition as that of Example 1 as illustrated in FIG. 5. The double-wall sleeve 16 of this example was so constructed that the sleeve 11 of cast iron of low thermal conductivity on the peripheral part played the role of insulation and the cylinder 15 of SKD61 inserted inside the sleeve 11 discharged the roll of withstanding the friction with the plunger. The cylinder 15 of SKD61 had undergone a nitriding hardening treatment. The sleeve 11 of cast iron of low thermal conductivity did not induce thermal deformation while in service because the thermal expansion coefficient thereof was substantially equal to that of the cylinder 15 of SKD61.

The double-wall sleeve 16 of this example enjoyed a service life of 20,000 to 30,000 shots. Naturally, the improvement in insulation prevented the die-cast products from forming furrows on the surface. As a result, the overall yield of the die-cast products obtained herein was about 1.5 times that of the die-cast products of the conventional sleeves.

COMPARATIVE EXAMPLE 3

A sleeve of the same shape as that of Example 2 was manufactured by using Sialon exhibiting the properties shown in Table 5. This sleeve was set in place in the same die casting machine as that of Example 2 and then tested for service life, with the temperature of the melt of ADC12 poured into the sleeve varied in the range of 943 to 973 K. The results are shown in Table 6.

TABLE 5

| | Thermal conductivity (at 373K) (W/m K) | Thermal expansion coefficient (RT-573K) (×10-6/K) | Hardness (Hv) |
|---|---|---|---|
| Comparative Example 3 (Sialon) | 21 | 3.0 | 1500 |
| Example 2 | 16 | 14 | 400 |
| Example 2 + boriding treatment | 16 | 14 | 2000 |

TABLE 6

| | Service life of sleeve (number of shots, × 1000) | | | |
|---|---|---|---|---|
| Temperature of melt | 943 | 953 | 963 | 973 |
| Comparative Example 3 (Sialon) | 1 | 8 | 43 | 74 |
| Example 2 | 10 | 9.5 | 6.2 | 5.1 |
| Example 2 + boriding treatment | 72 | 69 | 50 | 37 |

It is clearly noted from Table 6 that the service life of Sialon sharply shortened in accordance as the temperature of the melt lowered. The reason for this sudden decrease of the service life is that the solidification layer on the inner wall of the sleeve gained in volume, the inner wall of the sleeve and the plunger jointly generated galling, and the sleeve consequently sustained damage when the temperature of the melt of Al alloy to be poured rose. The sleeve formed of Sialon produced a crack in the interface and revealed deficiency in reliability because the thermal expansion coefficient of this sleeve was widely different from that of the peripheral parts such as, for example, the plunger.

INDUSTRIAL APPLICABILITY

Since the sleeve for a die casting machine according to this invention, as described above, is formed of a metal material possessing low thermal conductivity and, at the same time, excelling in reliability, it can prevent the temperature of the molten metal introduced therein from being lowered, improve the quality of a die-cast product, and exalt the reliability of the sleeve. Then, the die casting machine according to this invention affords die-cast products with high yield and, at the same time, improves the durability and the reliability of the machine proper notably because it uses the sleeve of the quality mentioned above. Thus, the sleeve for a die casting machine and the die casting machine according to this invention are useful for the manufacture of die-cast products of various light alloys represented by aluminum alloy.

We claim:

1. A sleeve for a die-casting machine, adapted to serve concurrently as a molten metal receiver and a pressure cylinder in said die-casting machine and formed of an iron-based alloy metallographically comprising a martensite phase or a mixed phase of a martensite phase with an austenite phase and having thermal conductivity of not more than 20 W/mK.

2. The sleeve for a die-casting machine according to claim 1, wherein said iron-based alloy contains at least Ni.

3. The sleeve for a die-casting machine according to claim 1, wherein said mixed phase has not less than 10% by surface area ratio of a martensite phase.

4. The sleeve for a die-casting machine according to claim 2, wherein said iron-based alloy contains 7 to 19% by weight of Ni.

5. The sleeve for a die-casting machine according to claim 4, wherein said iron-based alloy further contains 3 to 8% by weight of Si.

6. The sleeve for a die-casting machine according to claim 5, wherein said iron-based alloy further contains 0.3 to 2% by weight of C, 0.03 to 0.1% by weight of at least one member selected between Mg and Ca, and not more than 1.0% by weight of Mn.

7. The sleeve for a die-casting machine according to claim 6, wherein said iron-based alloy is a spheroidal graphite cast iron.

8. The sleeve for a die-casting machine according to claim 1, wherein said iron-based alloy has hardness of not less than Hv 300 on the Vickers hardness scale.

9. The sleeve for a die-casting machine according to claim 8, wherein said iron-based alloy has a thermal expansion coefficient of $11\times10^{-6}$ to $16\times10^{-6}$/K in a temperature range of from room temperature to 573 K.

10. The sleeve for a die-casting machine according to claim 1, wherein said iron-based alloy has thermal conductivity of not more than 18 W/mK.

11. The sleeve for a die-casting machine according to claim 2, wherein said sleeve is provided in at least part of the inner wall surface thereof with a surface-treated layer of high hardness.

12. The sleeve for a die-casting machine according to claim 11, wherein said surface-treated layer is a ceramic layer.

13. The sleeve for a die-casting machine according to claim 12, wherein said ceramic layer contains at least one member selected from the group consisting of borides, nitrides, and carbides as a main component thereof.

14. The sleeve for a die-casting machine according to claim 2, wherein said sleeve has inserted therein a cylinder formed of a corrosion-resistant alloy or abrasion-resistant alloy different in species from said iron-based alloy.

15. A die-casting machine, comprising:

a pair of dies consisting of a stationary die and a movable die, a bush disposed in said stationary die, a sleeve connected to said bush, adapted to serve concurrently as a molten metal receiver and a pressure cylinder, and formed of an iron-based alloy metallographically comprising a martensite phase or a mixed phase of a martensite phase with an austenite phase and having thermal conductivity of not more than 20 W/mK, a plunger for causing the molten metal introduced into said sleeve to be forced into said pair of dies, and a drive mechanism for said plunger.

16. The die-casting machine according to claim 15, wherein said iron-based alloy contains at least Ni.

* * * * *